US009028531B2

(12) United States Patent
Rohrig

(10) Patent No.: US 9,028,531 B2
(45) Date of Patent: May 12, 2015

(54) PACIFIER COMPRISING A SHIELD, AND SHIELD

(75) Inventor: Peter Rohrig, Vienna (AT)

(73) Assignee: Mam Babyartikel Gesellschaft m.b.H., Vienna (AT)

( * ) Notice: Subject to any disclaimer, the term of this patent is extended or adjusted under 35 U.S.C. 154(b) by 339 days.

(21) Appl. No.: 13/520,449

(22) PCT Filed: Jan. 10, 2011

(86) PCT No.: PCT/AT2011/000006
§ 371 (c)(1),
(2), (4) Date: Jul. 3, 2012

(87) PCT Pub. No.: WO2011/082439
PCT Pub. Date: Jul. 14, 2011

(65) Prior Publication Data

US 2013/0046342 A1 Feb. 21, 2013

(30) Foreign Application Priority Data

Jan. 11, 2010 (AT) ..... A 14/2010

(51) Int. Cl.
*A61J 17/00* (2006.01)

(52) U.S. Cl.
CPC ..... *A61J 17/00* (2013.01); *A61J 2017/001* (2013.01); *A61J 2017/008* (2013.01)

(58) Field of Classification Search
CPC ..... A61J 17/00; A61J 17/02; A61J 2017/001; A61J 2017/008
USPC ..... 606/234–236; D24/194–196
See application file for complete search history.

(56) References Cited

U.S. PATENT DOCUMENTS

| | | | | |
|---|---|---|---|---|
| 4,715,379 | A | 12/1987 | McCormick | |
| 5,653,731 | A * | 8/1997 | Rohrig | 606/234 |
| 5,954,749 | A | 9/1999 | Fields et al. | |
| 5,972,025 | A | 10/1999 | Taysom | |
| D441,083 | S * | 4/2001 | Roehrig | D24/194 |
| 6,514,275 | B2 * | 2/2003 | Rohrig | 606/234 |
| D547,456 | S * | 7/2007 | Ramos et al. | D24/194 |
| D548,847 | S * | 8/2007 | Dunn et al. | D24/194 |
| D626,653 | S * | 11/2010 | Roehrig et al. | D24/194 |

(Continued)

FOREIGN PATENT DOCUMENTS

| | | | |
|---|---|---|---|
| AT | 379508 | B | 1/1986 |
| DE | 3316824 | A1 | 11/1984 |
| DE | 200 17 878 | | 2/2001 |

OTHER PUBLICATIONS

International Search Report mailed Apr. 5, 2011; PCT/AT2011/000006.

(Continued)

*Primary Examiner* — Julian W Woo
*Assistant Examiner* — Shaun L David
(74) *Attorney, Agent, or Firm* — Ladas & Parry LLP

(57) ABSTRACT

Pacifier having a shield having a brace forming a circumferential outer frame on both sides of a central fixing portion having a teat opening, so that on both sides respectively one or two large-area openings are provided between the fixing portion and the brace, and respectively one further brace forming an inner frame is provided in these openings, wherein regions of the brace of the outer frame and of the brace of the inner frame, which are adjacent to one another at least in sections are not connected to one another.

14 Claims, 9 Drawing Sheets

(56) References Cited

U.S. PATENT DOCUMENTS

| | | | | |
|---|---|---|---|---|
| D636,496 | S * | 4/2011 | Roehrig et al. | D24/194 |
| D636,884 | S * | 4/2011 | Roehrig et al. | D24/194 |
| 2001/0012952 | A1 | 8/2001 | Rohrig | |
| 2002/0030029 | A1 * | 3/2002 | Hakim | 215/11.1 |
| 2002/0082642 | A1 * | 6/2002 | Shattles | 606/234 |
| 2003/0163162 | A1 * | 8/2003 | Uehara et al. | 606/234 |
| 2010/0063543 | A1 * | 3/2010 | Moses et al. | 606/236 |

OTHER PUBLICATIONS

International Preliminary Report on Patentability; dated Aug. 1, 2012; Appln. No. PCT/AT2011/00006.

Machine Translation of Austrian Office Action Ref No. R54402 with Search Report.

* cited by examiner

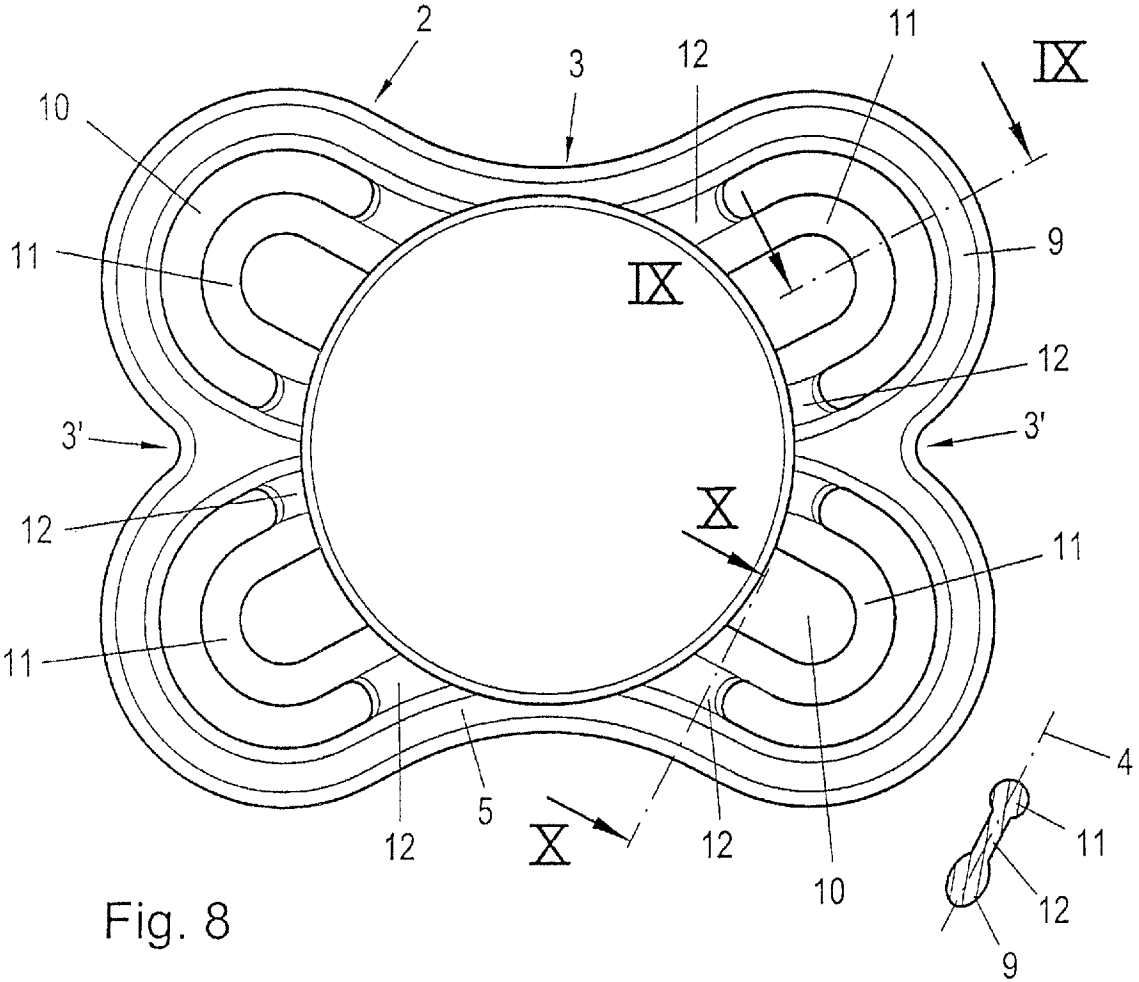
Fig. 8
Fig. 10
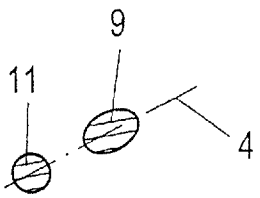
Fig. 9

PACIFIER COMPRISING A SHIELD, AND SHIELD

The invention relates to a pacifier comprising a shield having a brace forming a circumferential outer frame on both sides of a central fixing portion having a teat opening, so that on both sides respectively one or two large-area openings are provided between the fixing portion and the brace.

Known from U.S. Pat. No. 5,759,195 is a pacifier having a frame-shaped pacifier shield, where the outer frame is connected to a central fixing portion having a teat opening via a mesh-shaped connecting element; the central fixing portion here can have respectively one sickle-shaped ventilation opening on both sides. The mesh-shaped connecting element here consists of a comparatively thin plate compared with the outer frame, which has a plurality of small rectangular apertures. With the aid of this plate having a plurality of apertures, good ventilation of the skin should be achieved in the area of contact of the pacifier shield as far as possible; as a result of the plate-shaped connecting element, however, this pacifier shield is configured to be substantially stiff. A pacifier having a very similarly configured mesh-shaped grid which however has a plurality of circular apertures is known from U.S. Pat. No. 5,954,749.

A pacifier is further known from AT 379.508 in which the pacifier shield has a circumferential frame which is connected to the central portion having the teat opening by at least two lip covering webs provided on both sides of the central openings and running in the direction of the longer transverse axis of the teat. This design of the shield having only a single frame necessitates a comparatively solid configuration of the frame or the lip covering webs in order to ensure the stability or durability of the pacifier shield.

Further known from U.S. Pat. No. 6,514,275 B2 and US 2007/0260280 A1 is another pacifier having a frame-shaped pacifier shield, where the frame is supported on the central part having the teat. Here also the thickness of the frame must not go below a certain dimension in order to ensure sufficient stability and avoid breaking during use.

Further known from DE 33 16 824 A1 is a pacifier having an annular circumferential outer frame from which substantially radially running spokes extend to an inner hub part with a central opening.

It is consequently the object of the present invention to provide a constructively simple pacifier of the type specified initially or a pacifier shield, which can be manufactured cost effectively, in which a certain adaptability of the shield to the mouth or the jaw of the infant is achieved.

This is achieved in the pacifier of the type specified initially by the features according to the characterising part of claim 1. As a result of the connection-free configuration of the outer and inner frame, at least in sections, a pacifier shield in the manner of a resilient double frame is achieved, i.e. the outer and inner frame are not—as hitherto—substantially rigidly connected to one another but the braces of the two frames can be pivoted under application of force from their common plane forming a contact surface for the mouth area, so that the shield can advantageously be adapted to the mouth area or the jaw of the infant. An expedient adaptability of the shield is provided in any case if the braces of the outer and the inner frame are not connected to one another over at least more than half their longitudinal extension.

In order to achieve an expedient overall stiffness of the shield with braces having a comparatively small material thickness, it is favourable if the braces of the outer and of the inner frame are resiliently connected to one another in sections at least via one element, preferably a web. The connection of the outer and inner frame provided only in sections provides a shield that is stable and at the same time has a certain flexibility. In addition, the web or the webs increase the stability of the shield so that a particularly filigree design of the braces of the outer and of the inner frame can be achieved, by which means appreciable savings in material can be achieved compared with known frame-shaped pacifier shields, whereby the manufacturing costs can advantageously be reduced. The lower mass of the pacifier accompanying the saving in material additionally increases the wearing comfort for infants. If the web has a smaller wall thickness than the braces of the outer or of the inner frame, this promotes the deformability of the webs so that a certain mobility between inner and outer frame is ensured; in addition, the material expenditure for the connecting webs can be kept low. Different stiffnesses of the shield as desired can be achieved by the choice of material, the material thickness, the width and the area of the arrangement of the webs between the two frames. Since the webs can be fabricated in a simple manner by means of inserts in the injection moulding tool during manufacture of the shield in the injection moulding process, an individual adaptation of the stiffness of the shield can be achieved with little expenditure. If the inner frame is free from the connecting web over more than half of its outer circumference, the desired mobility of the two frames with respect to one another is ensured in any case. Furthermore, a ventilation of the mouth area which is pleasant for the infant or removal of saliva is ensured.

In order to achieve a relatively large ventilation opening, it is favourable if the braces of the inner frame substantially have the same profile as the braces of the outer frame; the braces of the inner frame running substantially parallel to the braces of the outer frame divide the large-area openings of the outer frame formed between the outer frame and the central fixing portion in such a manner that the remaining recesses in the pacifier shield are sufficiently large to serve as emergency breathing or ventilation holes.

If the braces are substantially configured as round edge-free monofilaments, a low material expenditure is achieved at the same time as high wearing comfort since the braces do not rest with a flat contact surface all over the mouth area of the infant but substantially only rest against the mouth area along a linear surface.

The braces of the outer and/or the inner frame are preferably substantially elliptical in cross-section whereby a high stability is achieved with low expenditure of material at the same time. In addition, the elliptical cross-sectional area of the braces has the advantage that no sharp edges are formed with the result that a high wearing comfort is achieved.

In order to provide a pacifier shield projecting slightly from the mouth area if possible, it is favourable if the longitudinal axis of the elliptical cross-section of the braces is disposed in the longitudinal extension plane of the shield.

It is also of advantage with regard to a stable design of the pacifier shield allowing a particularly high wearing comfort if the braces of the outer and/or of the inner frame have an approximately circular cross-sectional profile, where the braces are flattened in the area of a contact surface and the opposite surface. By this means, a visually pleasing appearance reminiscent of a monofilament fibre is also achieved.

The ratio of the height to the width of the braces is preferably between 0.5 and 0.9, in particular substantially 0.7.

In order to adapt the pacifier shield to the increased loads occurring in the area of the outer frame, it is favourable if the braces of the outer frame have a larger cross-sectional area than the braces of the inner frame.

The web can on the one hand be disposed centrally between outer and inner surface of the braces; with regard to high wearing comfort it is also particularly favourable if the web is disposed flush with the inner surface of the braces, which inner surface is provided for contact in the mouth area.

It has been found that an advantageous combination of low material expenditure and high stability can be achieved if the ratio of the wall thickness or height of the webs to the wall thickness or height of the braces is smaller than 0.7.

With a view to an expedient, stable design of the pacifier shield, it is favourable if the webs are disposed in the area of a longitudinal symmetry axis of the shield.

In order to provide sufficient space in the nose area of the infant when wearing the pacifier, it is advantageous if the brace of the outer frame provided on both sides of the fixing portion converges with the fixing portion in a central longitudinal-side recess of the pacifier shield. For reasons of symmetry, these central pulled-in sections of the shield can be configured the same on both longer sides of the shield so that there is no different upper and lower sides of the pacifier. These central pulled-in sections on the longer sides of the shield result in a substantially lemniscate-shaped outer outline of the shield.

In a preferred embodiment of the pacifier, it is provided that the outer braces on the two shorter sides of the shield each have a central pulled-in section. A particularly stable outer frame is provided if the outer brace in the area of the pulled-in sections is connected to the central fixing portion. Together with the central pulled-in sections on the two longer sides of the pacifier shield, a substantially four-leaved shape of the pacifier shield is obtained, where respectively two large-area openings are formed on both sides of the central fixing portion, in each of which one brace of the inner frame is provided. In this design, the outer frame is connected to the central fixing portion at four connection points in total, with the result that a very stable, load-bearing shield is provided; the braces can be particularly filigree-like, i.e. having comparatively small wall thickness.

A particularly stable connection of the braces of the inner frame to the central section can be achieved if the web directly adjoins the central fixing portion and is preferably formed integrally with said portion.

The invention is explained in further detail hereinafter with reference to preferred exemplary embodiments shown in the drawings but should not be restricted to these.

In detail:

FIG. 8 shows a plan view of the pacifier according to FIG. 5 on the front side having a cover cap;

FIG. 9 shows a sectional view along the line IX-IX in FIG. 8 to illustrate the profile of the shield cross-section in an area free from the web;

FIG. 10 shows a sectional view along the line X-X in FIG. 8 to illustrate the profile of the shield cross-section in the area of the web;

FIGS. 1 to 5 show a pacifier 1 according to a first embodiment of the invention. The pacifier 1 has a shield 2 in which central recesses 3 are provided on the two longer sides of the shield 2. The outer outline of the shield 2 is therefore approximately lemniscate-shaped, as is particularly apparent from the plan view of the pacifier 1 shown in FIG. 2.

Figure 6:
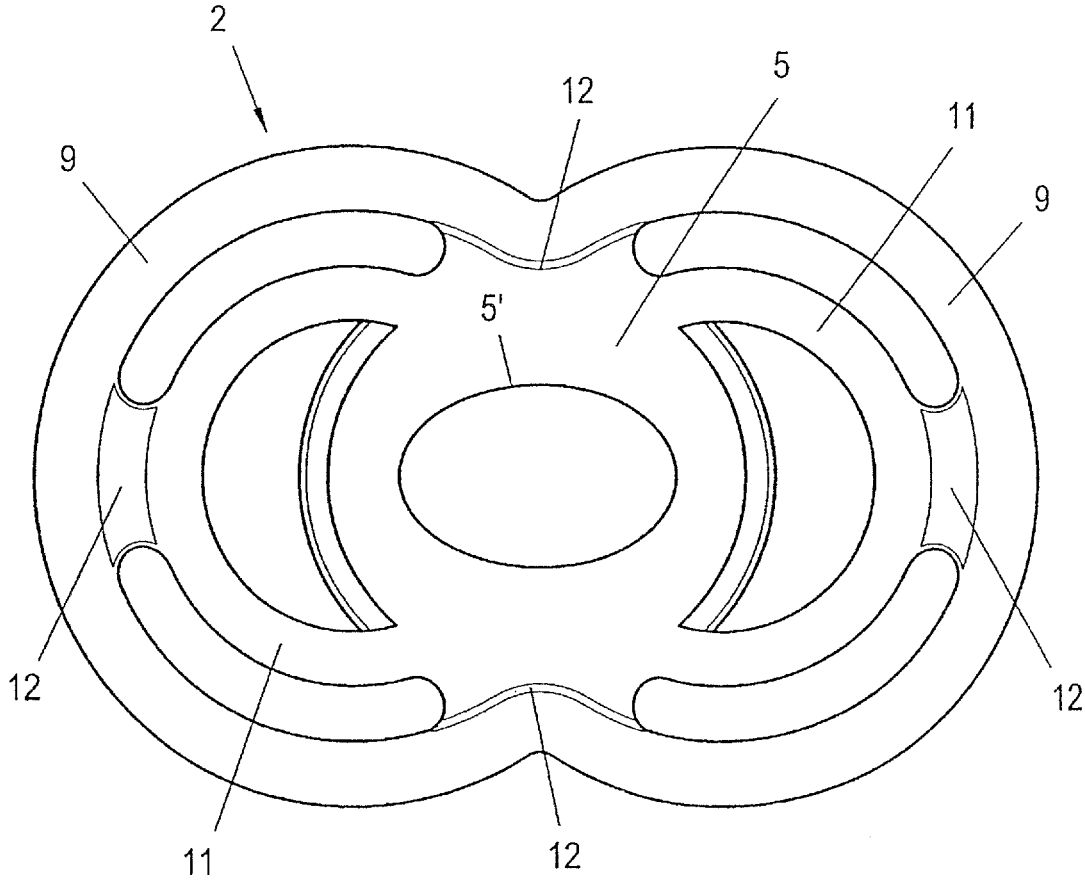
FIG. 6 shows a view of the rear side of the pacifier shield according to FIGS. 1 to 3 omitting the teat.

The shield 2 has a central, approximately round fixing portion 5 (cf. FIG. 6) in which a teat opening 5' is provided to receive a stem of a teat 7 (not shown in FIG. 6). As can be seen from FIG. 1 and FIG. 5, the shield 2 is concavely arched starting from the approximately flat central fixing portion 5 corresponding to the contour of the mouth area of an infant. The teat 7 is preferably fastened or clamped with a terminating protrusion (not shown in the figures) or the like in a round hood-shaped cap 8, which is placed on the central fixing portion 5; the teat can however be connected to the pacifier shield in any arbitrary manner, in particular also formed integrally.

The shield 2 has a brace 9 forming a circumferential outer frame which, with the central fixing portion 5 comprising the teat opening, forms respectively one large-area opening 10. Respectively one brace 11 forming an inner frame is provided in the openings 10. The braces 11 of the inner frame are provided with their ends respectively on both sides of the central fixing portion 5 and connected to the central fixing portion 5. The braces 11 of the inner frame have substantially the same profile as the braces 9 of the outer frame so that a large-area opening 10 free from plastic material remains. In the design of the pacifier 1 shown in FIGS. 1 to 5 having a substantially lemniscate outline of the shield 2, the inner braces 11 in the plan view according to FIG. 2 have substantially a C shape.

In order to produce a stable and at the same time flexible shield 2 with the aid of the outer frame and the inner frame, the braces 9, 11 of the outer or inner frame are resiliently connected to one another via webs 12 provided on both sides of the central fixing portion 5. As can be seen from FIG. 2, the webs 12 are disposed in a longitudinal symmetry axis 4' of the shield 2. The inner frame is free from the webs 12 at least over more than half of its outer circumference so that despite their connection, a certain mobility is given between outer and inner frame. The webs 12 have a profile tapering towards the centre in relation to the longitudinal extension plane of the shield 2. Since the extension of the webs 12 in the longitudinal extension plane of the shield 2 is greatest at the connecting surfaces with the webs 9, 11, the stability of the resilient connection between outer and inner frame is not adversely affected despite the material-saving tapering profile of the webs 12.

Figure 1:
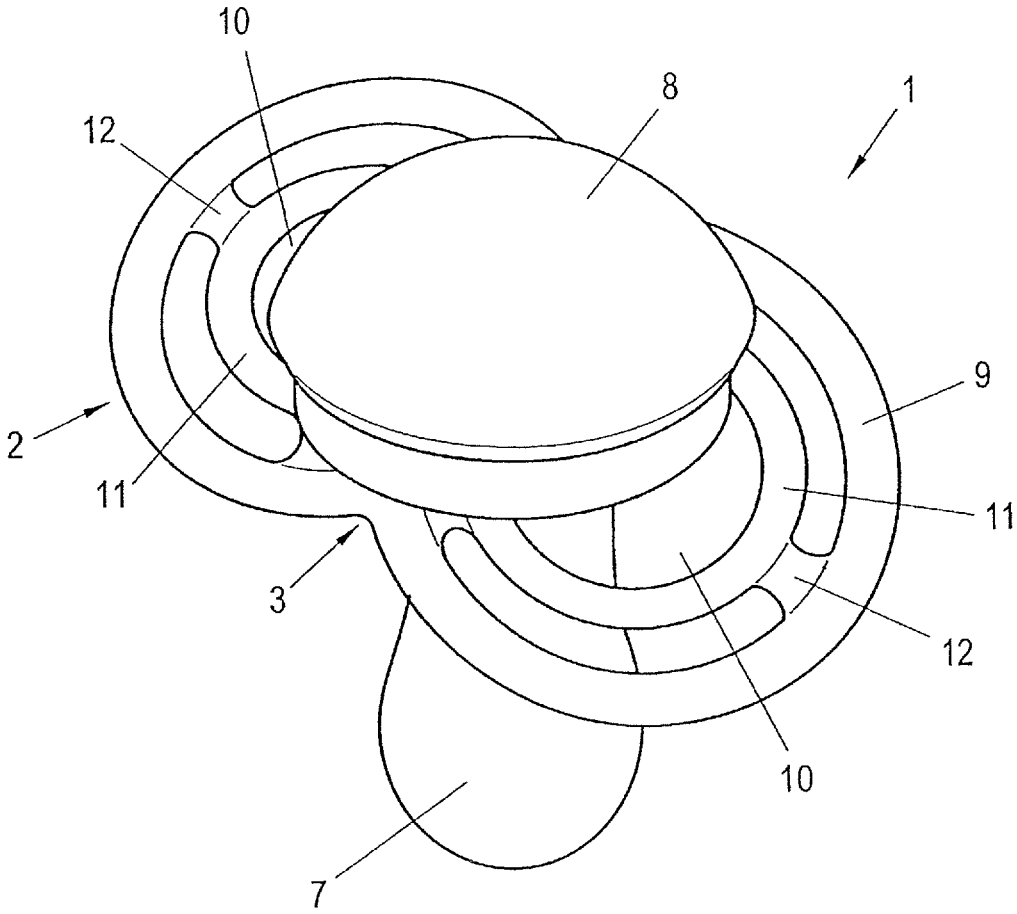
FIG. 1 shows a perspective view of a pacifier according to a first preferred embodiment of the invention in which a substantially lemniscate-shaped brace of an outer frame is connected to braces of an inner frame via webs provided on both sides of a central fixing portion, disposed in a longitudinal axis of symmetry of the shield.
Figure 2:
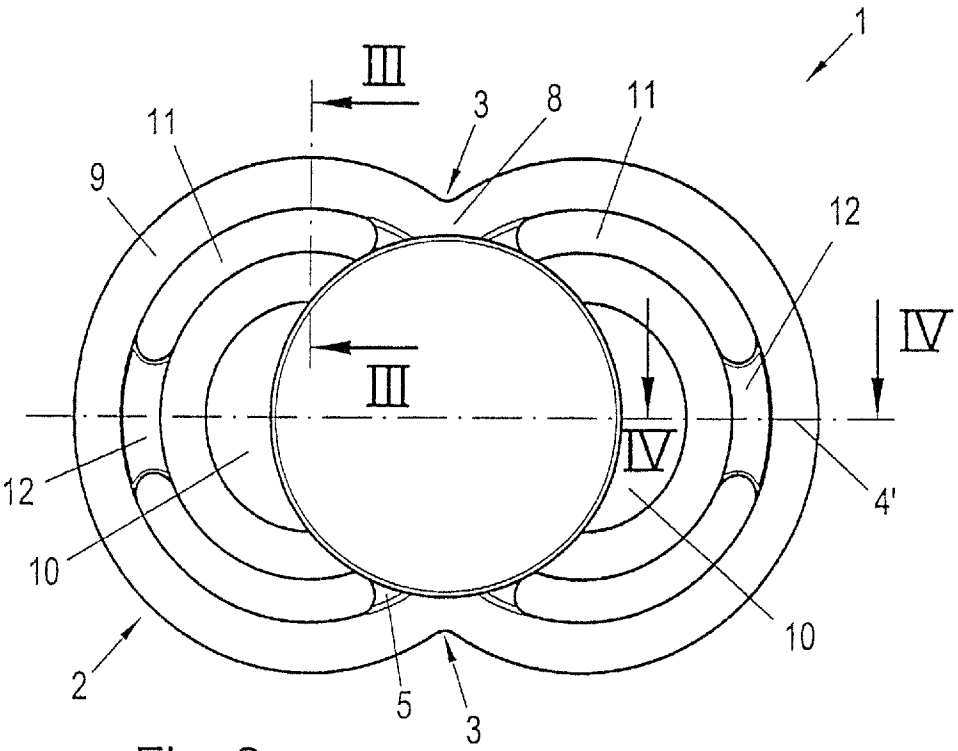
FIG. 2 shows a plan view of the pacifier according to FIG. 1 on the front side having a cover cap.
Figure 3:
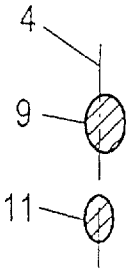
FIG. 3 shows a sectional view along the line III-III in FIG. 2 to illustrate the profile of the shield cross-section in an area free from the web.
Figure 5:
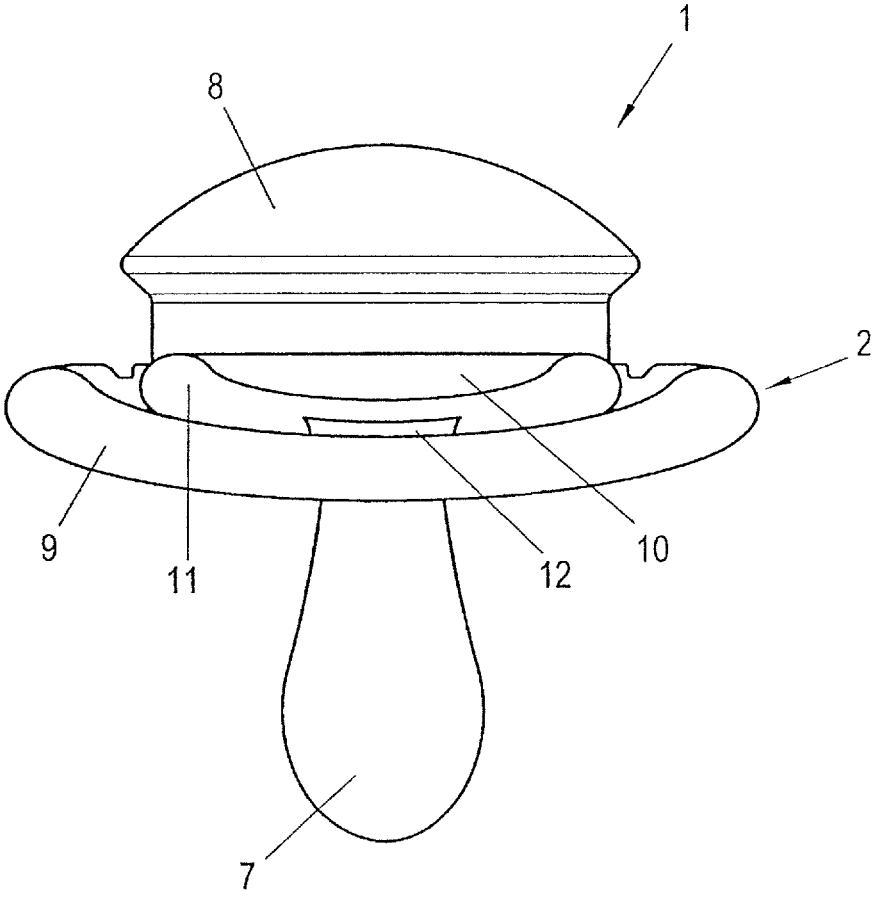
FIG. 5 shows a side view of the pacifier according to FIGS. 1 to 4.

FIG. 3 shows a sectional view along the line III-III in FIG. 2 from which the profile of the shield cross-section can be deduced in an area free from the web 12. It can be seen from this sectional view that the inner or outer braces 9, 11 have substantially elliptical cross-sectional areas, where a longitudinal axis 4 of the elliptical cross-section is disposed in the longitudinal extension plane of the shield. The braces 11 of the outer frame have a greater thickness than the braces 9 of the inner frame to take account of the greater loading in this region. The outer brace 9 here has a height or thickness of about 2.8 and a width of about 4 mm; the inner brace on the other hand has a height of about 2 mm and a width of about 3.4 mm. The ratio of the height to the width of the braces 9, 11 is therefore about 0.5-0.7.

Figure 4:
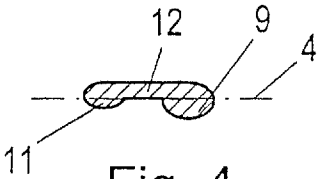
FIG. 4 shows a sectional view along the line IV-IV in FIG. 2 to illustrate the profile of the shield cross-section in the area of the web.

The profile of the shield cross-section in the area of the web 12 can be seen from the section along the line IV-IV in FIG. 2, which is shown in FIG. 4. The web 12 accordingly has a wall thickness or height of about 1.3 mm which is thus less than that of the brace 11 of the inner frame. The ratio of the wall thickness or height of the web 12 to the wall thickness or height of the inner braces 11 is less than 0.7 and is in particular about 0.65. The wall thickness of the web 12 is substantially constant. The web 12 is preferably formed integrally with the inner or outer frame. Possible material for the shield 2 manufactured by an injection moulding process are plastic materials, in particular hard plastics, e.g. thermoplastics but also soft plastics such as thermoplastic elastomers or also silicones, where such plastic materials are sufficiently known per se. As is further apparent from FIG. 4, the web 12 is disposed flush with the inner surface of the braces 9, 11 provided for contact in the mouth area.

A second preferred pacifier 1 according to the invention is shown in FIGS. 7 to 12. In order to avoid repetition, principally the differences from the pacifier 1 explained in connection with FIGS. 1 to 6 are discussed hereinafter.

Figure 7:
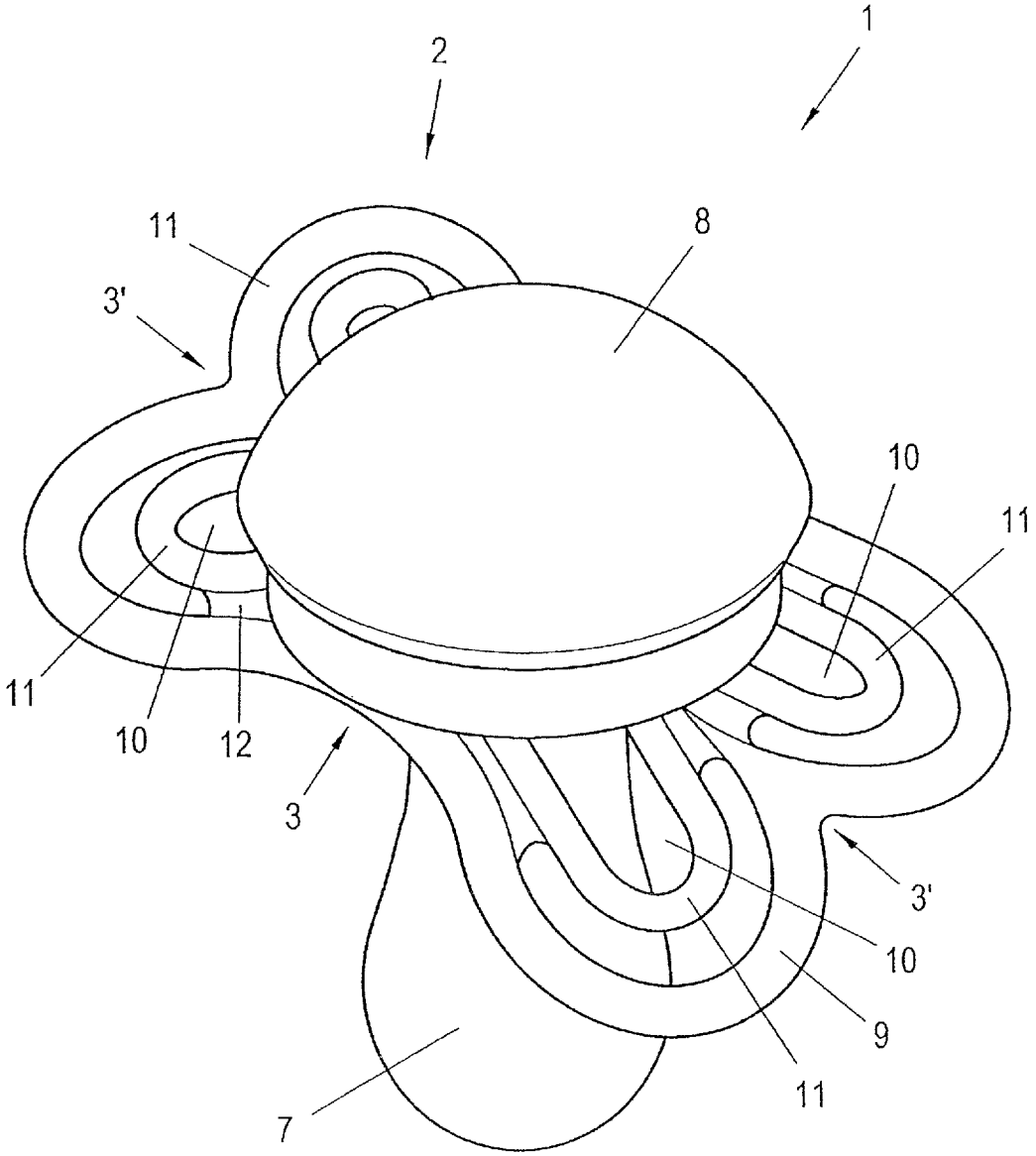
FIG. 7 shows a perspective view of a pacifier according to a second embodiment of the invention in which the brace of the outer frame has central pulled-in sections or recesses on the shorter or longer sides of the shield and is connected to the inner braces via webs formed directly on the central section of the shield.
Figure 11:
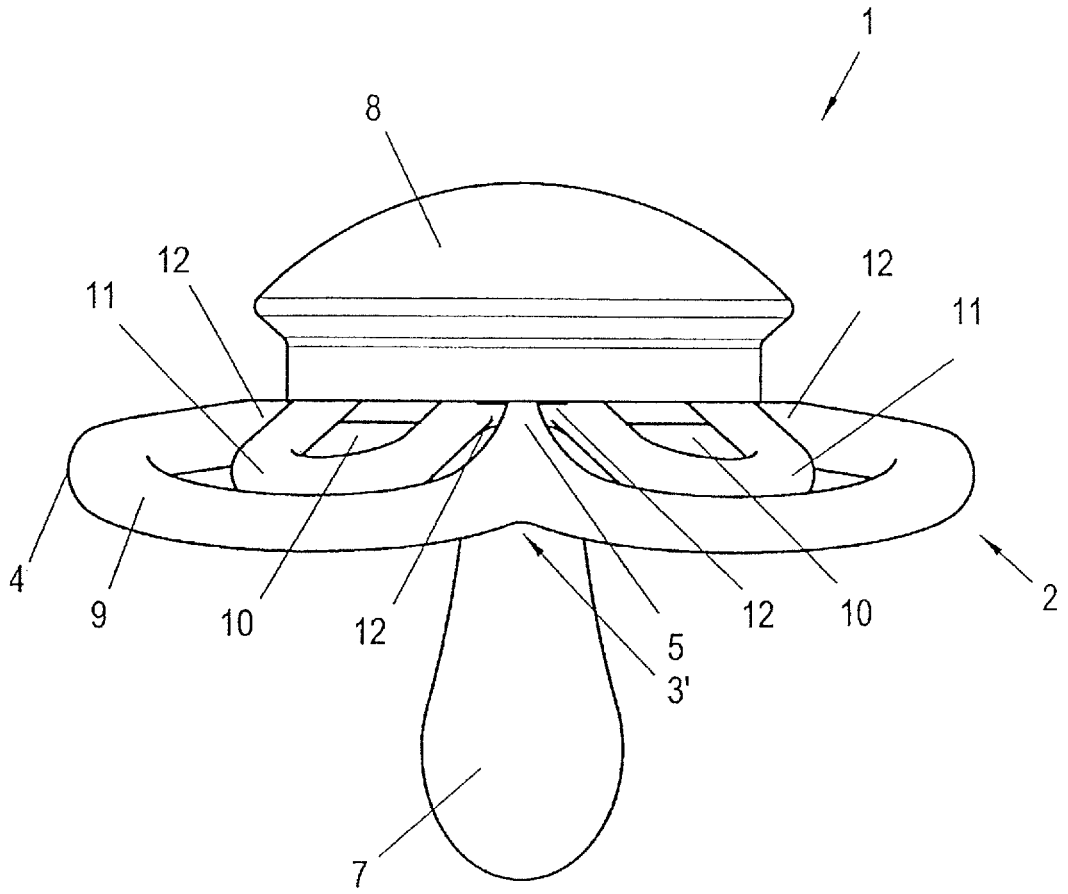
FIG. 11 shows a side view of the pacifier according to FIGS. 6 to 9.
Figure 12:
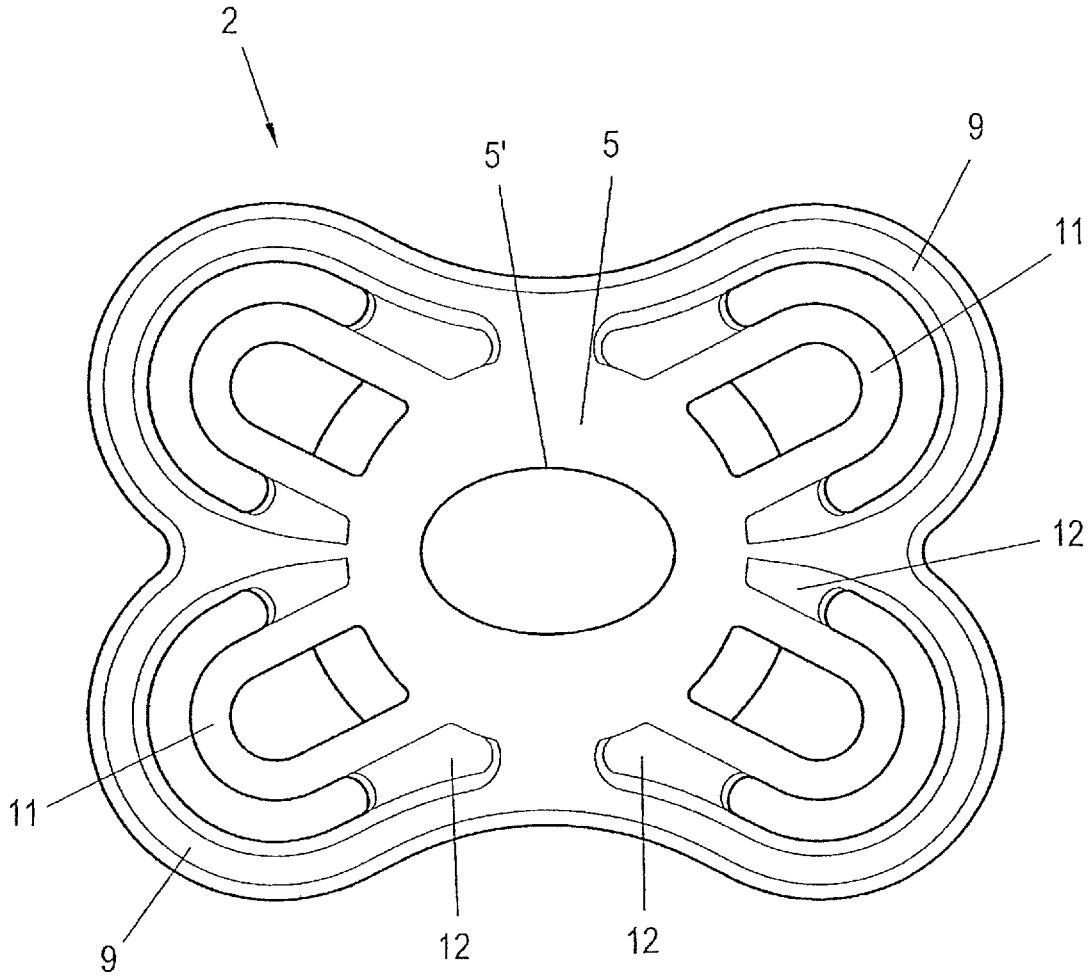
FIG. 12 shows a view of the rear side of the pacifier shield having the teat 7 according to FIGS. 7 to 11 omitting the teat.

In the design of the pacifier 1 shown in FIGS. 7 to 12, additionally to the central recesses 3 provided on the longer sides of the shield 2, the brace 9 of the outer frame additionally has central pulled-in sections 3' on the shorter sides of the shield 2 so that a substantially four-leafed shape of the shield 2 is obtained. The braces 9 of the outer frame are supported at the central pulled-in sections 3' on the central fixing portion 5 so that the outer frame is connected to the central fixing portion 5 at a total of four connection points. Respectively two large-area openings 10 are formed on both sides of the fixing portion 5, in which openings respectively one brace 11 of the inner frame having a U-shape in the plan view according to FIG. 7 is provided. The end regions of the straight sections of the U-shaped braces 11 are integrally connected to the central fixing portion 5 (cf. FIG. 12) of the shield 2. Each U-shaped brace 11 of the inner frame is connected to the outer frame via respectively two webs 12 directly adjoining the central fixing portion 5.

FIGS. 9 and 10 respectively show sectional views corresponding to FIGS. 3 and 4 respectively from which the profile of the shield cross-section can be seen in an area free from the web 12 or in the area of the web 12. Accordingly, the U-shaped braces 11 have an approximately circular cross-section which is slightly flattened in the area of a contact surface and of the opposite surface. By this means, a stable and material-saving design is achieved with a visually pleasing appearance which is similar to a monofilament fibre. The brace 9 of the outer frame also has a flattened round cross-sectional profile, whose longitudinal axis 4 is disposed in the longitudinal extension plane of the shield 2. In view of the comparatively high stressing in the area of the outer frame, the wall thickness of about 2.5 mm of the braces 9 of the outer frame is greater than that of the inner frame, which is about 2.1 mm. As can be further seen from FIG. 9, the web 12 in this design is disposed centrally between outer or inner surface of the braces 9, 11.

Figure 13:
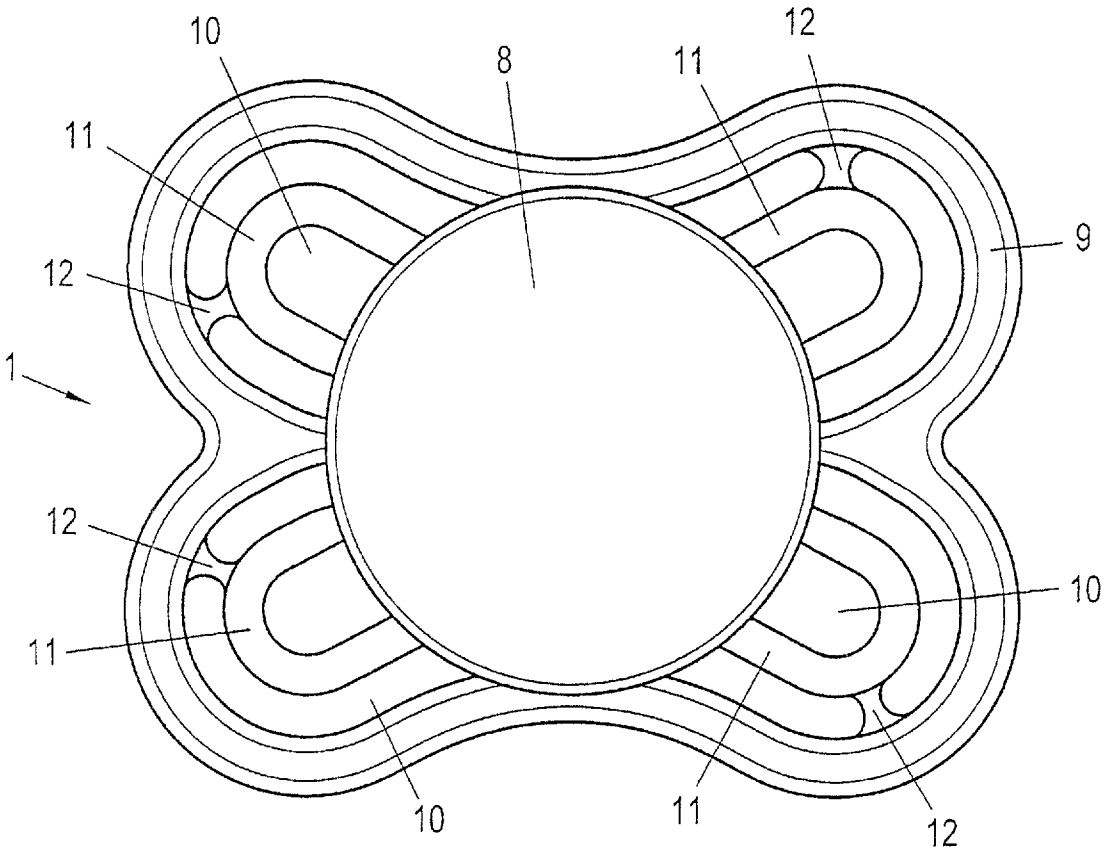
FIG. 13 shows a plan view of a pacifier similar to FIG. 8, where further possibilities for connection of outer and inner frame of the pacifier shield by means of webs are illustrated.

The spring effect of the double frame provided in the present pacifier, comprising the outer or inner frame or braces 9 or 11 can be adjusted in a simple but nevertheless very efficient manner by location and dimensioning of the webs 12 between these frames or braces 9, 11, as is also deduced from the diagram in FIG. 13 where the location of the webs 12 on the left-hand side of the pacifier shield shown is situated further inwards, closer to the horizontal longitudinal axis of the pacifier, compared to the location of the webs 12 on the right-hand side. In both cases, the webs 12 can move even closer (inwards or outwards) to the position of the cap 8; furthermore, it is also possible to provide two webs 12 for each inner frame 11 for connection to the outer frame 9 without these webs 12 moving so far onto the cap 8, as shown in FIG. 8.

The webs 12, as shown in FIG. 13, are comparatively narrow in order to thus achieve a lower stiffness of the double frame. If, however, a higher stiffness of the double frame is desired, apart from a more outer position of the webs 12, a broader shape of the webs 12 can naturally also be provided for this, as can be seen from FIG. 4.

Overall, it is therefore found that the webs 12 which are moulded by injection moulding in an injection moulding tool with the aid of inserts can advantageously be used to determine the spring effect. Consequently, orthodontists can have their "desired shield" provided according to the desired properties; these adjustable properties or properties for which allowance can be made in particular include the stiffness of the double frame and therefore the pressure loading exerted by the shield on the jaw, where this stiffness or pressure loading is also dependent on the elastic modulus of the selected material and on the position of the webs 12, apart from their width or thickness. The webs 12 on the left or right side in FIG. 13 can in any case achieve different spring effects even with identical material and identical dimensions.

The invention claimed is:

1. Pacifier comprising a shield having a brace forming a circumferential outer frame on both sides of a central fixing portion having a teat opening, so that on both sides respectively one or two large-area openings are provided between the fixing portion and the brace, wherein respectively one further brace forming an inner frame is provided in the openings, wherein regions of the brace of the outer frame and of the brace of the inner frame, which are adjacent to one another at least in sections are not connected to one another, wherein the braces of the outer and of the inner frame are resiliently connected to one another in sections at least via one web which has a smaller wall thickness than the braces of the outer or of the inner frame, wherein the braces are substantially configured as round edge-free monofilaments.

2. The pacifier according to claim 1, wherein the braces of the outer and of the inner frame are not connected to one another over at least more than half of their longitudinal extension.

3. The pacifier according to claim 1, wherein the braces of the inner frame substantially have the same profile as the braces of the outer frame.

4. The pacifier according to claim 1, wherein the ratio of the height to the width of the braces is between 0.5 and 0.9.

5. The pacifier according to claim 1, wherein the braces of the outer frame have a larger cross-sectional area than the braces of the inner frame.

6. The pacifier according to claim 1, wherein the web is disposed flush with the inner surface of the braces provided for contact in the mouth area.

7. The pacifier according to claim 1, wherein the ratio of the wall thickness of the web/height of the webs to the wall thickness of the braces/or height of the braces is smaller than 0.7.

8. The pacifier according to claim 1, wherein the webs are disposed in the area of a longitudinal symmetry axis of the shield.

9. The pacifier according to claim 1, wherein the outer braces each have a central pulled-in section on both shorter sides of the shield.

10. The pacifier according to claim 1, wherein the web directly adjoins the central fixing portion.

11. Shield for a pacifier according to claim 1.

12. Pacifier comprising a shield having a brace forming a circumferential outer frame on both sides of a central fixing portion having a teat opening, so that on both sides respectively one or two large-area openings are provided between the fixing portion and the brace, wherein respectively one further brace forming an inner frame is provided in the openings, wherein regions of the brace of the outer frame and of the brace of the inner frame, which are adjacent to one another at least in sections are not connected to one another, wherein the braces of the outer and of the inner frame are resiliently connected to one another in sections at least via one web which has a smaller wall thickness than the braces of the outer or of the inner frame, wherein the braces of the outer and/or the inner frame are substantially elliptical in cross-section.

13. The pacifier according to claim 12, wherein the longitudinal axis of the elliptical cross-section of the braces is disposed in the longitudinal extension plane of the shield.

14. Pacifier comprising a shield having a brace forming a circumferential outer frame on both sides of a central fixing portion having a teat opening, so that on both sides respectively one or two large-area openings are provided between the fixing portion and the brace, wherein respectively one further brace forming an inner frame is provided in the openings, wherein regions of the brace of the outer frame and of the brace of the inner frame, which are adjacent to one another at least in sections are not connected to one another, wherein the braces of the outer and of the inner frame are resiliently connected to one another in sections at least via one web which has a smaller wall thickness than the braces of the outer or of the inner frame, wherein the braces of the outer and/or of the inner frame have an approximately circular cross-sectional profile, wherein the braces are flattened in the area of a contact surface and the opposite surface.

* * * * *